US006755695B1

(12) United States Patent
Yu

(10) Patent No.: US 6,755,695 B1
(45) Date of Patent: Jun. 29, 2004

(54) SHUNTING SOCKET FOR TELEPHONES

(75) Inventor: Piao-Lung Yu, Taipei (TW)

(73) Assignee: Tsay-E International Inc., Taipei (TW)

( * ) Notice: Subject to any disclaimer, the term of this patent is extended or adjusted under 35 U.S.C. 154(b) by 11 days.

(21) Appl. No.: 10/337,776

(22) Filed: Jan. 8, 2003

(51) Int. Cl.[7] ..... H01R 13/64; H01R 27/02; H01R 25/00; H01R 31/00; H01R 33/88

(52) U.S. Cl. ..... 439/676; 439/638

(58) Field of Search ..... 439/676, 638, 439/536, 452, 76.1

(56) References Cited

U.S. PATENT DOCUMENTS 4,648,682 A * 3/1987 Tubbs ..... 439/391
4,738,635 A * 4/1988 Harrington et al. ..... 439/452
4,764,121 A * 8/1988 Ditzig ..... 439/21
4,968,260 A * 11/1990 Ingalsbe ..... 439/76.1
5,106,306 A * 4/1992 Ditzig ..... 439/26
5,562,493 A * 10/1996 Ferrill et al. ..... 439/536
5,819,893 A * 10/1998 Wagner et al. ..... 191/12.4
2002/0111077 A1 * 8/2002 Keenum ..... 439/676

* cited by examiner

*Primary Examiner*—Chandrika Prasad
(74) *Attorney, Agent, or Firm*—Bacon & Thomas PLLC

(57) ABSTRACT

A shunting socket for telephones is composed of a body and two receptacles respectively installed at two sides of the body. The receptacles are rotatable about the body to locate their notches at the top side, so that mounting cords connected in the notches will not trip someone passing by the shunting socket.

3 Claims, 4 Drawing Sheets

SHUNTING SOCKET FOR TELEPHONES

BACKGROUND OF THE INVENTION

1. Field of the Invention

The present invention is related to a shunting socket for telephones, and more particularly to a shunting socket which has two receptacles rotatable about a body.

2. Description of Related Art

A shunting socket for telephones is used for connecting multiple telephones in one line. A conventional shunting socket for telephones has a plurality of notches at the front sides, so that mounting cords connected in the notches must be placed on the ground. Someone passing by the shunting sockets may be tripped by the mounting cords on the ground.

Therefore, the invention provides a rotatable shunting socket to mitigate and/or obviate the aforementioned problems.

SUMMARY OF THE INVENTION

The main objective of the invention is to provide a shunting socket of which an orientation of notches can be changed.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
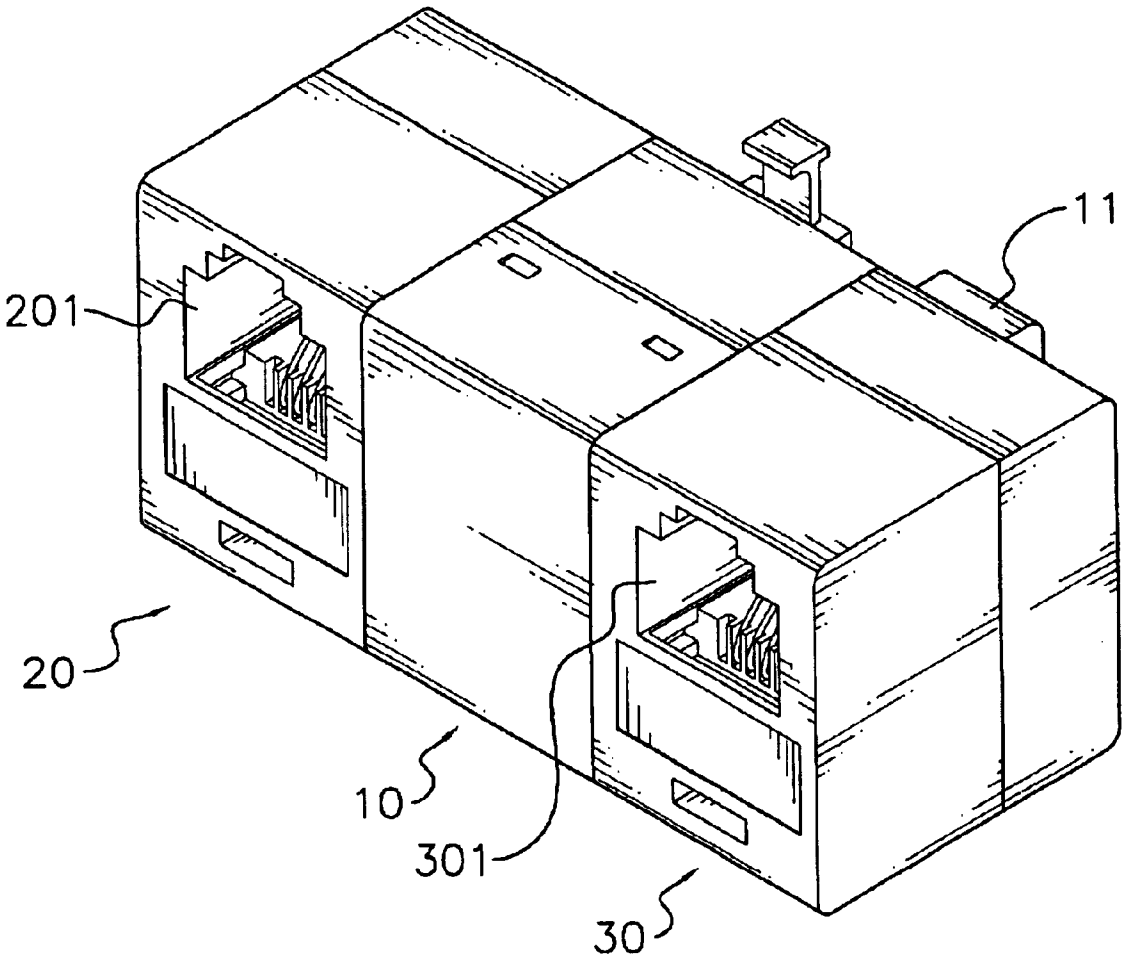
FIG. 1 is a perspective view of a shunting socket for telephones in accordance with the present invention.
Figure 2:
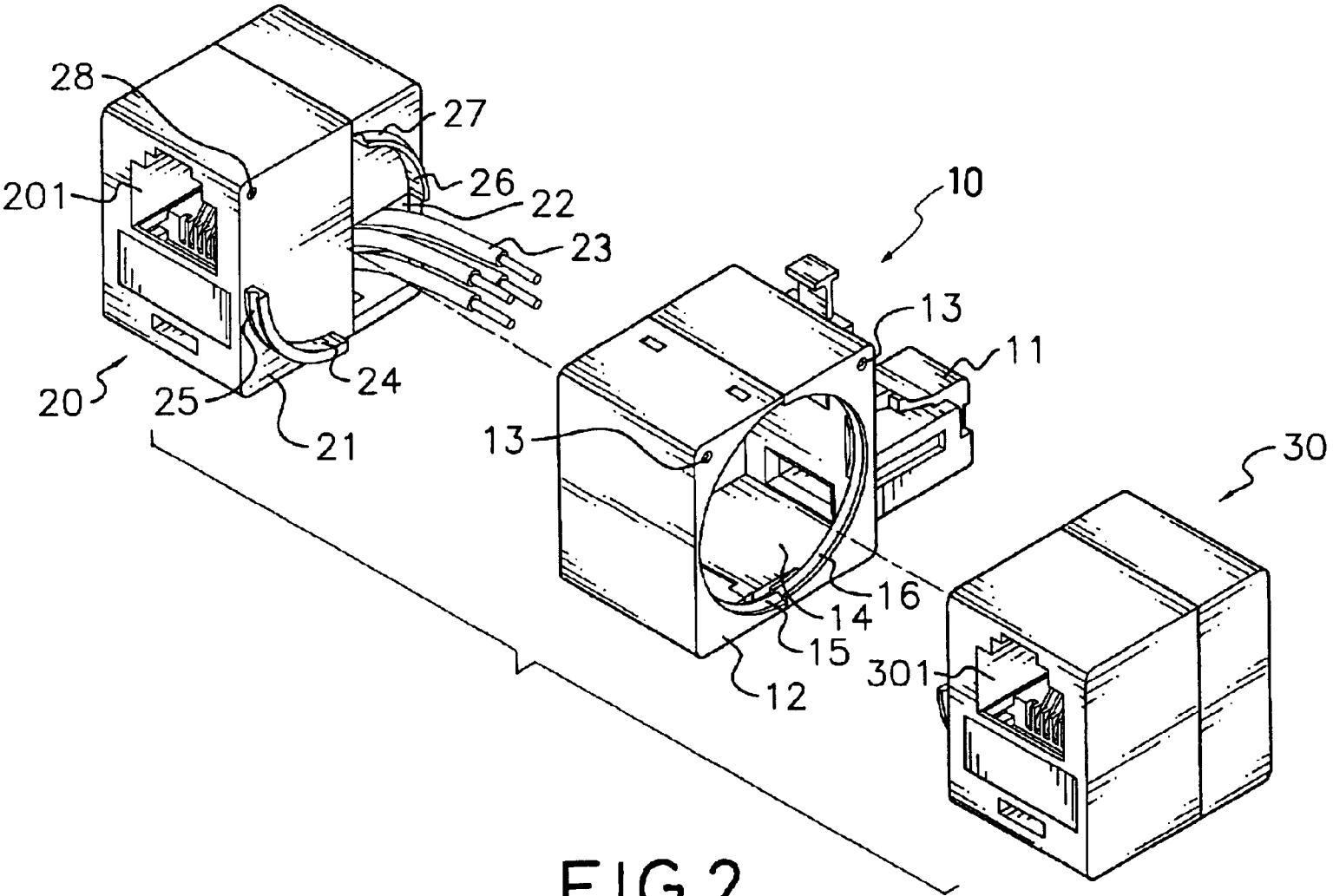
FIG. 2 is an exploded perspective view of the shunting socket in FIG. 1.
Figure 3:
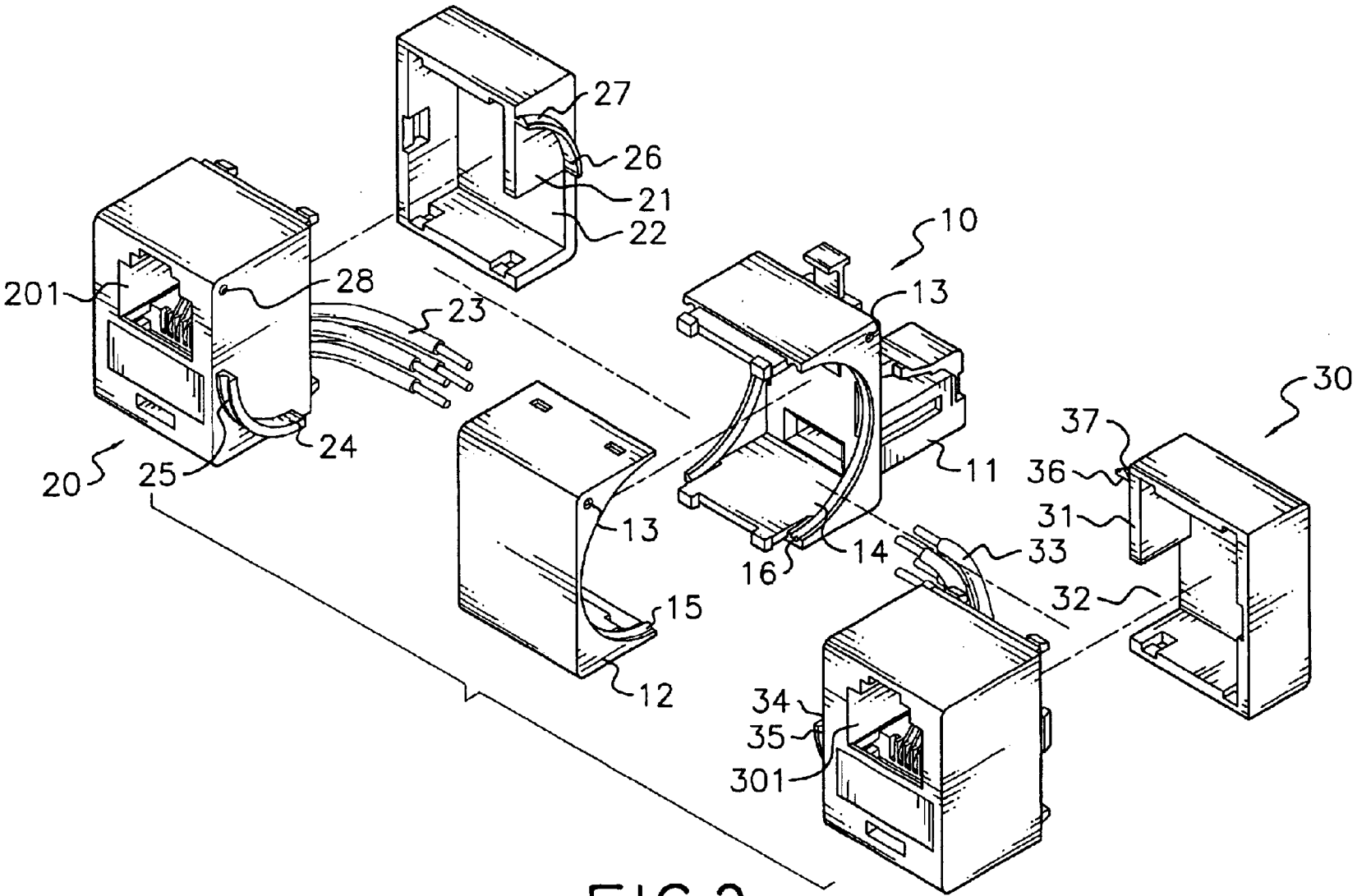
FIG. 3 is a further exploded perspective view of the shunting socket in FIG. 2.

Referring to FIGS. 1–3, a shunting socket for telephones in accordance with the present invention is composed of a body (10) and two receptacles (20, 30) respectively electrically connected and mounted at two sides of the body (10).

The body (10) has a connector (11) formed at a back side thereof for securing the socket in a wall and electrically connecting with a telephone line. The body (10) has two opposite side surfaces (12) and two circular openings (14) respectively defined through the side surfaces (12). Each of the side surfaces (12) has two recesses (13) defined therein and respectively adjacent the back surface and a front surface of the body (10). Each of the circular openings (14) has a protrusion (15) formed along a half circumference thereof adjacent the front surface of the body (10), and a slot (16) defined along the other half circumference thereof adjacent the back surface of the body (10).

The first receptacle (20) has a first notch (201) defined at a front side thereof for connecting a mounting cord (not shown or numbered). The first receptacle (20) has a first side (21) facing one of the side surfaces (12) of the body (10), and a first hole (22) is defined through the first side (21). First wires (23) from the first receptacle (20) extend through the first hole (22) and the circular opening (14) to electrically connect the first receptacle (20) and the body (10).

A first ear (24) and a second ear (26) are formed at the first side (21) and match the corresponding circular opening (14), wherein the first ear (24) has a first channel (25) matching the corresponding protrusion (15), and the second ear (26) has a first ridge (27) matching the corresponding slot (16). The first ear (24) and the second ear (26) are each formed as a quarter of a circle. A first lug (28) is formed on the first side (21) and can be positioned in the corresponding recess (13). Therefore, the first receptacle (20) is rotatably mounted on the body (10).

The second receptacle (30) has a second notch (301) defined at a front side thereof for connecting a mounting cord (not shown or numbered). The second receptacle (30) has a second side (31) facing the other side surface (12) of the body (10), and a second hole (32) is defined through the second side (31). Second wires (33) from the second receptacle (30) extend through the second hole (32) and the circular opening (14) to electrically connect the second receptacle (30) and the body (10).

A third ear (34) and a fourth ear (36) are formed at the second side (31) and match the corresponding circular opening (14), wherein the third ear (34) has a second channel (35) matching the corresponding protrusion (15), and the fourth ear (36) has a second ridge (37) matching the corresponding slot (16). The third ear (34) and the fourth ear (36) are also each formed as a quarter of a circle. A second lug (not shown or numbered) is formed on the second side (31) and can be positioned in the corresponding recess (13). Therefore, the second receptacle (30) is rotatably mounted on the body (10).

In an original status, as shown in FIGS. 1 and 2, the notches (201, 301) are located at the front side, and the lugs of the receptacles (20, 30) are respectively positioned in the recesses (13) adjacent the front side.

Figure 4:
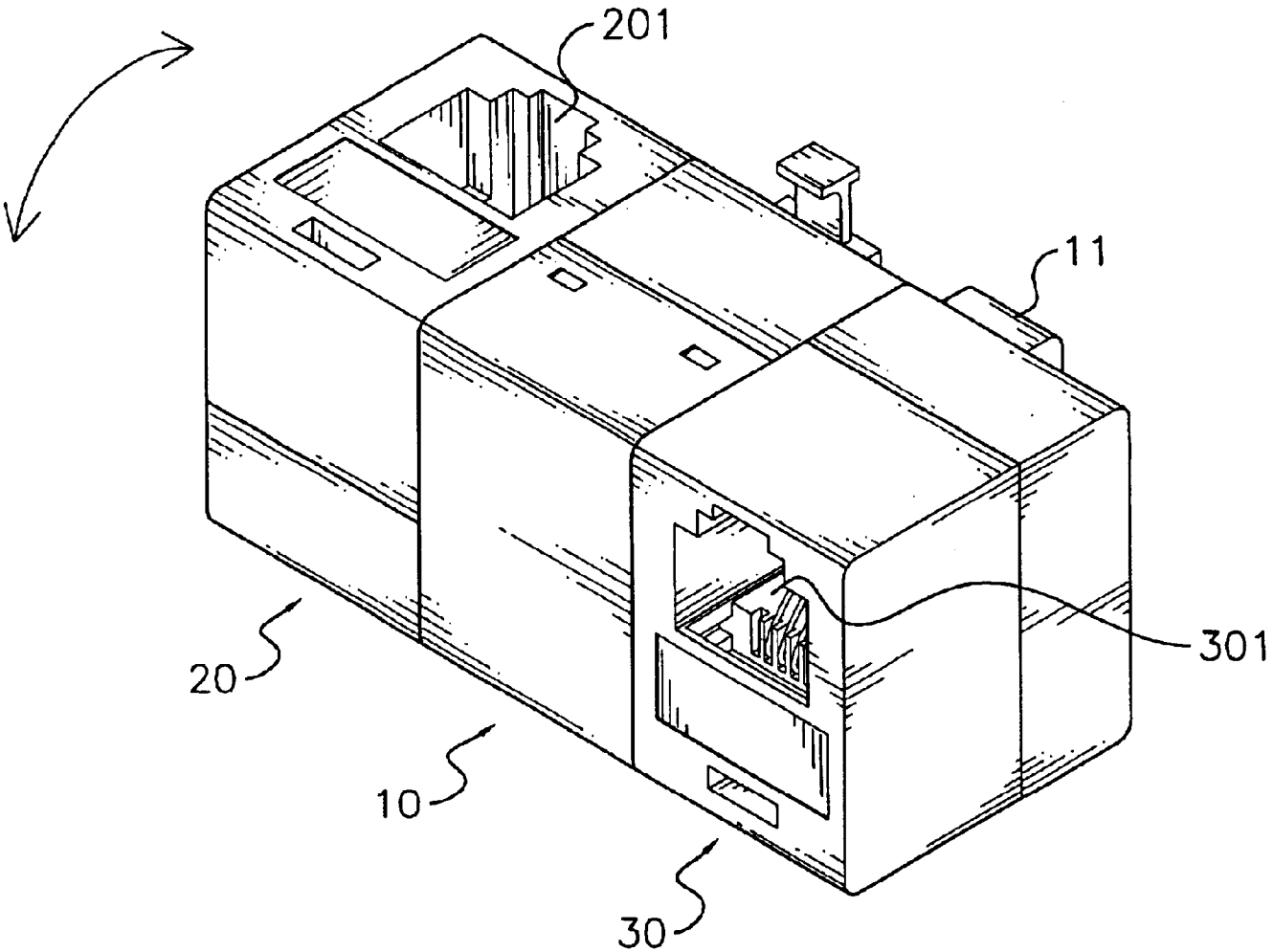
FIG. 4 is a perspective view showing that a receptacle of the shunting socket is turned 90 degrees about a body.

Referring to FIG. 4, because the protrusion (15) can be moved along the first channel (25) and the first ridge (27) can be moved along the slot (16), the first receptacle (20) can be rotated upwards 90° about the body (10) to locate the first notch (201) at the top side. In this case, the first lug (28) is positioned in the other recess (13) adjacent the back surface of the body (10).

In a similar way, the second receptacle (20) can be rotated upwards 90° to locate the second notch (301) at the top side.

Therefore, when the receptacles (20, 30) are rotated to locate the notches (201, 301) at the top side, the mounting cords connected in the notches (201, 301) do not need to place on the ground and will not trip someone passing by the shunting socket.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shunting socket for telephones comprising:

a body (10) having a connector (11) formed at a back surface thereof, two circular openings (14) respectively defined through two opposite side surfaces (12), each circular opening (14) having a protrusion (15) formed along a first half circumference, and a slot (16) defined along a second half circumference;

a first receptacle (20) rotatably mounted at a first of the side surfaces (12), the first receptacle (20) having a first notch (201) defined at a front side of the receptacle, a first side (21) facing the first side surface (12), a first hole (22) is defined through the first side (21), first wires (23) from the first receptacle (20) extending through the first hole (22) and the circular opening (14) to electrically connect the first receptacle (20) and the body (10), a first ear (24) and a second ear (26) formed at the first side (21) and matching the corresponding circular opening (14), wherein the first ear (24) has a first channel (25) matching the corresponding protrusion (15), and the second ear (26) has a first ridge (27) matching the corresponding slot (16); and a second receptacle (30) rotatably mounted at the second side surface (12), the second receptacle (30) having a second notch (301) defined at a front side of the receptacle (30), a second side (31) facing the second side surface (12), a second hole (32) defined through the second side (31), second wires (33) from the second receptacle (30) extending through the second hole (32) and the corresponding circular opening (14) to electrically connect the second receptacle (30) and the body (10), a third car (34) and a fourth ear (36) formed at the second side (31) and matching the corresponding circular opening (14), wherein the third ear (34) has a second channel (35) matching the corresponding protrusion (15), and the fourth ear (36) has a second ridge (37) matching the corresponding slot (16).

2. The shunting socket as claimed in claim 1, wherein each of the side surfaces (12) has two recesses (13) defined therein and respectively adjacent the back surface and a front surface of the body (10), and the first and the second receptacles (20, 30) have two lugs (28) respectively formed on the first side (21) and the second side (31), and positioned in the corresponding recesses (13).

3. The shunting socket as claimed in claim 1, wherein the ears (24, 26, 34, 36) are each formed as a quarter of a circle.

* * * * *